US005762357A

United States Patent [19]

Ratzek et al.

[11] Patent Number: 5,762,357

[45] Date of Patent: Jun. 9, 1998

[54] SAFETY BINDING FOR SNOWBOARDS

[75] Inventors: Thomas Ratzek, Rosenheim; Christian Niedermayer, Schechen, both of Germany

[73] Assignee: F2 International Ges. m.b.H., Kirchdorf/Drems, Austria

[21] Appl. No.: 366,060

[22] Filed: Dec. 29, 1994

[30] Foreign Application Priority Data

Feb. 24, 1994 [DE] Germany ..... 44 06 074.2

[51] Int. Cl.[6] ..... A63C 9/00

[52] U.S. Cl. ..... 280/607; 280/618; 280/14.2

[58] Field of Search ..... 280/607, 611, 280/617, 613, 618, 14.2, 633, 634

[56] References Cited

U.S. PATENT DOCUMENTS

| | | | |
|---|---|---|---|
| 3,918,732 | 11/1975 | Wulf | 280/618 |
| 4,728,116 | 3/1988 | Hill | 280/618 |
| 4,893,831 | 1/1990 | Pascal et al. | 280/618 |
| 4,901,454 | 2/1990 | Wlakhoff | 280/607 |
| 4,928,988 | 5/1990 | Hue | 280/607 |
| 5,028,068 | 7/1991 | Donovan | 280/618 |
| 5,044,654 | 9/1991 | Meyer | 280/613 |
| 5,190,311 | 3/1993 | Carpenter et al. | 280/607 |
| 5,354,088 | 10/1994 | Vetter et al. | 280/618 |
| 5,499,837 | 3/1996 | Hale et al. | 280/607 |
| 5,577,755 | 11/1996 | Metzger et al. | 280/607 |

FOREIGN PATENT DOCUMENTS

| | | | |
|---|---|---|---|
| 0350411 | 1/1990 | European Pat. Off. . | |
| 0373548 | 6/1990 | European Pat. Off. . | |
| 0396133 | 7/1990 | European Pat. Off. . | |
| 0432588 | 6/1991 | European Pat. Off. . | |
| 0397969 | 5/1993 | European Pat. Off. . | |
| 2233081 | 1/1975 | France . | |
| 8716654 | 7/1988 | Germany . | |
| 8815236 | 3/1989 | Germany . | |
| 8902125 | 6/1989 | Germany . | |
| 3809194 | 9/1989 | Germany . | |
| 8908061 | 10/1989 | Germany . | |
| 3838324 | 5/1990 | Germany . | |
| 3910156 | 10/1990 | Germany . | |
| 3916233 | 11/1990 | Germany . | |
| 3841912 | 1/1991 | Germany . | |
| 4209112 | 3/1991 | Germany . | |
| 9014833 | 3/1991 | Germany . | |
| 4034099 | 8/1991 | Germany . | |
| 4018276 | 9/1991 | Germany . | |
| 9200088 | 5/1992 | Germany . | |
| 9202987 | 6/1992 | Germany . | |
| 4209112 | 10/1992 | Germany . | |
| 4219036 | 1/1993 | Germany | 280/607 |
| 3925164 | 5/1993 | Germany . | |
| 9215933 | 5/1993 | Germany . | |
| 9216831 | 5/1993 | Germany . | |
| WO 92/09339 | 6/1992 | WIPO . | |
| 93/14835 | 8/1993 | WIPO | 280/607 |

*Primary Examiner*—Brian L. Johnson
*Assistant Examiner*—Min Yu
*Attorney, Agent, or Firm*—Dougherty & Dremann

[57] ABSTRACT

A safety binding for snowboards has a base plate (1) on which the snowboarder's boot is fastened. This base plate (1) is fixed in its turning position by a spring plunger (8) and a stop pin (7), but can be turned out of this position when the torque acting on it exceeds a value preset by the initial tension of the spring (10) of the spring plunger (8). The base plate (1) is rigidly connected with the snowboard by means of a turning plate (2) and is not detached from the snowboard even in the case of a "turning release".

5 Claims, 5 Drawing Sheets

SAFETY BINDING FOR SNOWBOARDS

FIELD OF THE INVENTION

The invention relates to a safety binding for snowboards.

BACKGROUND OF THE INVENTION

A safety binding of this kind is disclosed in U.S. Pat. No. 5,044,654. This safety binding has an elongated binding plate that is broadened in its center where it has a circular opening going through the plate. This binding plate is secured to the snowboard boot by means of retaining clips (front and heel clips). A central bolt fastened to the snowboard projects through the central opening during normal use and centers the binding plate. The binding plate is provided with two spring-loaded locking bolts, which are pushed into the opening of the binding plate where they engage recesses of the central bolt, thereby fixing the binding plate in position relative to the central bolt and thus relative to the snowboard. The pressure of the spring-loaded bolts is adjustable. "Excessive" forces, the limiting value of which is adjustable through the spring force, arising between the binding plate and the central fastening bolt will cause the locking bolts to be forced out of the central opening of the binding plate so that the entire binding plate will detach itself from the snowboard.

Other safety bindings for snowboards are disclosed in the following patent publications (GM=Gebrauchsmuster= utility model patent):

| | | |
|---|---|---|
| US 4,728,116 | FR 2 233 081 | EP 0 397 969 B1 |
| EP 0 432 588 A2 | EP 0 373 548 A2 | EP 0 42 588 A2 |
| EP 0 373 548 A2 | EP 0 350 411 A2 | DE-GM 92 16 831 |
| DE-GM 92 15 933 | DE-GM 92 00 088 | DE-GM 92 02 987 |
| DE-GM 90 14 833 | DE-GM 89 08 061 | DE-GM 89 02 125 |
| DE-GM 88 15 236 | DE-GM 87 16 654 | DE 39 25 164 C2 |
| DE 38 41 912 C2 | DE 40 34 099 A1 | DE 40 18 276 A1 |
| DE 39 16 233 A1 | DE 39 10 156 A1 | DE 38 38 324 A1 |
| DE 38 09 194 A1 | | |

The common thing about all snowboard bindings known up to now is that the snowboarder's foot under excessive stress is completely separated from the snowboard if the binding is released. This concept derived from skiing causes some problems with snowboards, however. Since the snowboarder's feet are fastened to a single board, it is not sufficient to separate only the overstressed foot from the board due to the risk that the other foot will be overstressed because of the longer lever arm of the board then in action, and it is not guaranteed that the second binding will also be released in due time. There is thus a serious risk of injury for the snowboarder when only one of the two binding components is released. To solve this problem, the aforementioned documents,

| | | |
|---|---|---|
| DE 39 10 156 A1, | DE 39 16 233 A1, | DE 40 34 099 A1, |
| DE 38 41 912 C2, | DE 39 25 164 C2, | DE-GM 90 14 833, |
| DE-GM 92 02 987, | DE-GM 92 00 088, | DE-GM 92 15 933, |

EP 0 350 411 A2 and EP 0 97969 B1, have already suggested coupling the two release bindings with each other by means of cables, hydraulic lines or rods so that a release of one of the bindings will automatically lead to a release of the other, even if the connection forces between boot and board at the latter binding have not yet reached the pre-set release value. The consequential problem here, however, is how to prevent the board, when separated from its user, from injuring its user or other people on the slope. There is the risk with the check strap used earlier in skiing that the board will injure its user in a fall, the injury risk being greater with the snowboard than with skis because the snowboard is heavier. A transition was thus also made in skiing to the so-called ski stoppers, that is, braking claws that automatically go into action to hinder the ski from moving off by itself over considerable distances. Applying this principle of the ski stoppers to snowboards was suggested in DE 40 18 276, but it did not prove to be satisfactory in practice. Because of its greater sliding surface (compared to that of a ski), the snowboard is not reliably stopped thereby, particularly on hard or icy ski runs. In this case, other people on the ski runs are subject to a considerable risk of injury from uncontrolled snowboards racing down the slope. It is unacceptable for a snowboarder to be protected from injury in an accident caused by a safety binding while the system allows others "not involved" to be seriously injured or even killed.

A further problem with all of the aforementioned safety bindings for snowboards is that the release forces for all release devices, as in twisting of the foot around the longitudinal axis of the shin bone (turning falls) and tipping of the foot and/or the shin bone in relation to an axis perpendicular to the surface of the snowboard (frontal or transverse falls), are equally great. If the release force is set at the lowest value that will safely avoid injury to the snowboarder in any fall possible, there can be an unwanted release with a load applied in other directions and thus a greater risk of injury.

OBJECTS OF THE INVENTION

These problems are solved or at least alleviated with the present invention. The object of the invention is thus to improve the snowboard binding of the type mentioned in the beginning so as to avoid injuries to its user because the board is secured to the user's feet through a "release" of the binding without causing any additional risk of injury to the users or to uninvolved persons nearby.

SUMMARY OF THE INVENTION

The invention is based on the knowledge that more than 90% of all foot and leg injuries in snowboarding occur in so-called twisting falls in which a torsional force arises from the boot, over the ankle joint and shin bone, and up to the knee joint, the concept of torsion relating here to the longitudinal axis of the shin bone. Falls in which the shin bone is tipped relative to an axis that is vertical to the surface of the snowboard, on the other hand, are not critical for the most part. If the shin bone is tipped transverse to the direction of travel, forces arising are only minimal because the board is set on edge. Likewise, if the shin bone is tipped forward or backward in the longitudinal direction of the snowboard, the critical limiting value of the loading force is reached only in extremely rare cases for three reasons. Firstly, the human ankle bone can be bent to a relatively high degree without a risk of injury; secondly, ordinary snowboard boots and the currently used bindings are quite flexible in this tipping direction; thirdly, the board can be set on edge because of the relatively short lever arm between the tip or the end of the snowboard and the binding nearest thereto, the forces are thus absorbed. Consideration should also be given in this respect to the fact that in the case of a frontal fall (relative to the direction of travel), for example, if the tip of the snowboard runs into an obstacle, for example, the forward leg of the snowboarder is put under stress in this tipping direction, while the rearward leg exercises a tensile force on the rear end of the board, so that as a whole, the board "gives" and it is set on edge toward the front, which causes a decrease in the forces acting on the forward leg. Based on this knowledge, the invention suggests in principle that only a twisting release be provided, maintaining rigid fixing in position of the boot in all other directions a force acts, the boot remaining fixed on the board even when there is a twisting release at the binding. The boot can thus be turned only relative to the board.

BRIEF DESCRIPTION OF THE DRAWINGS

The invention will be explained in more detail below using example embodiments with reference to the drawings in which.

The same reference symbols in the figures refer to the same or corresponding components throughout.

DETAILED DESCRIPTION

Figure 1:
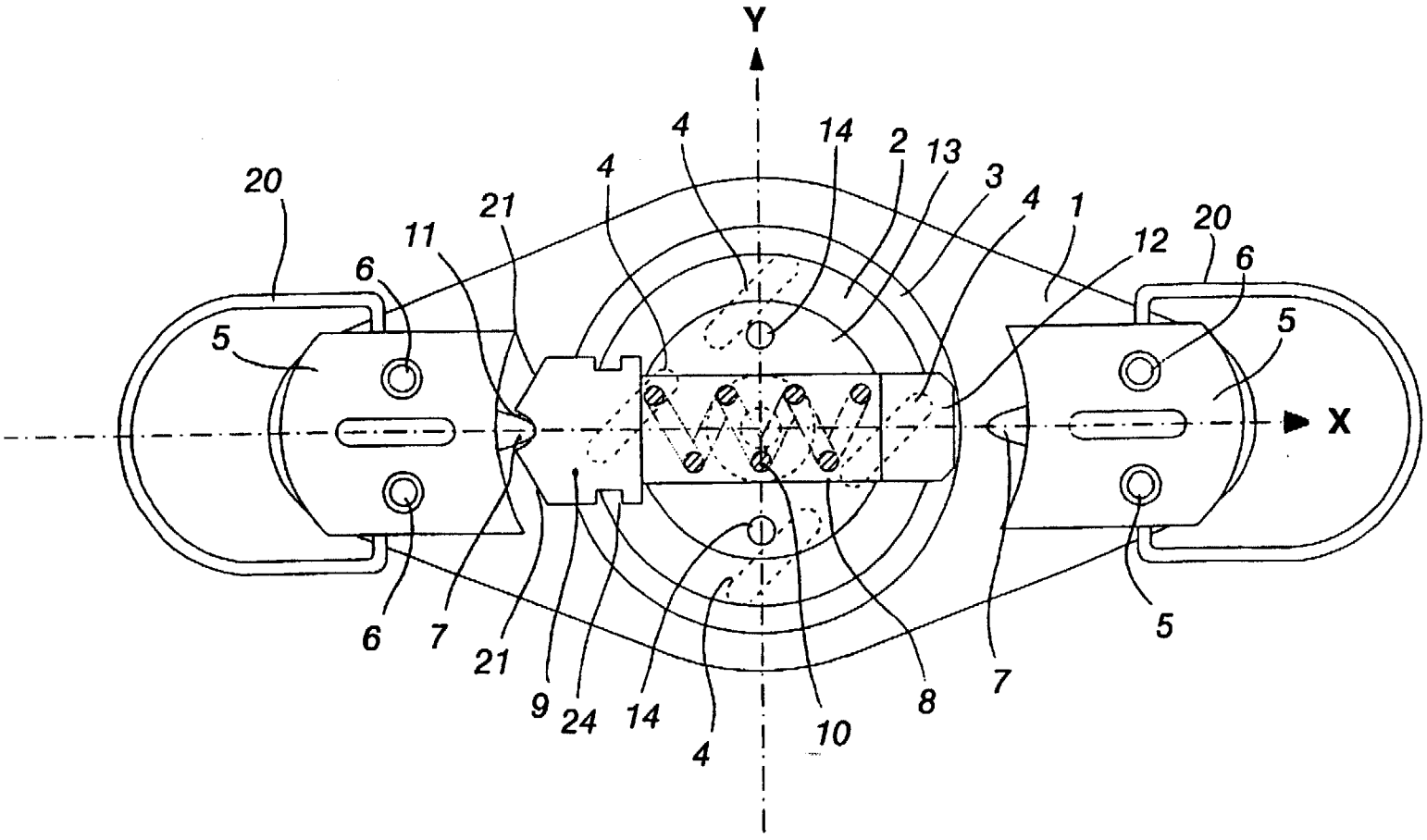
FIG. 1 is a plan view of the safety binding in accordance with a first example embodiment of the drawing.
Figure 2:
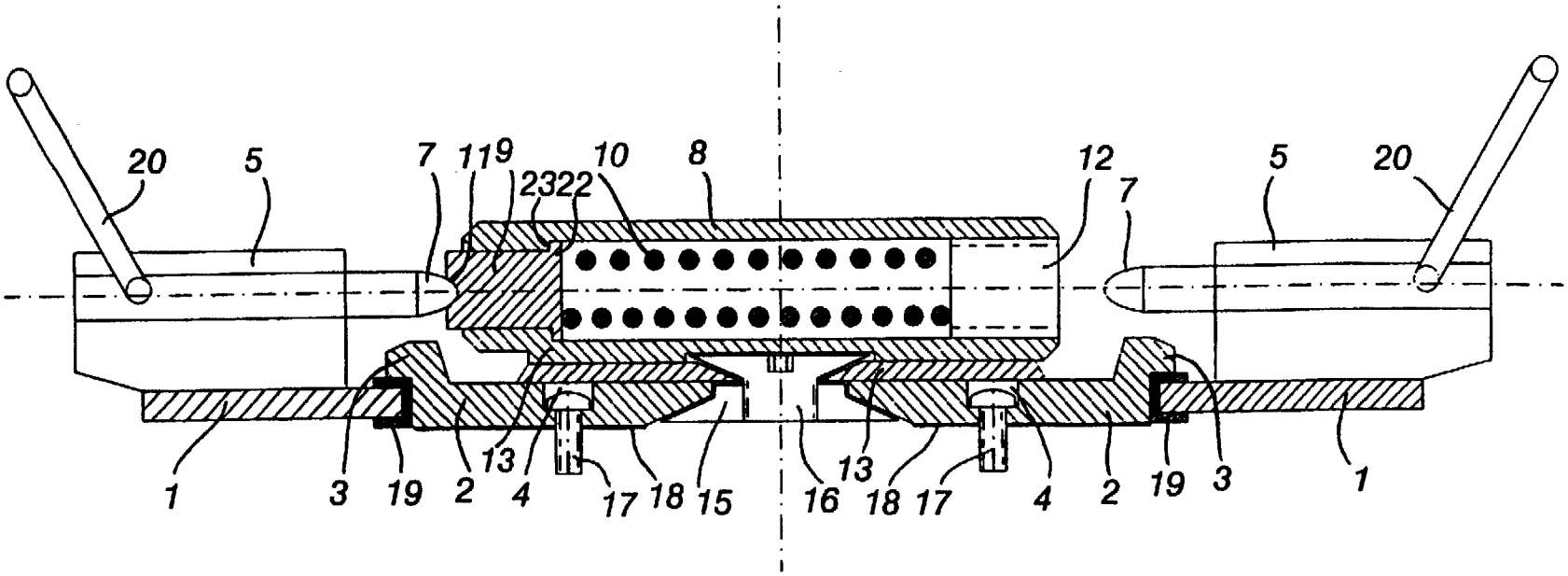
FIG. 2 is a longitudinal section of the safety binding of FIG. 1.

In the example embodiment illustrated in FIGS. 1 and 2, the safety binding has a base plate 1 having the approximate configuration of a rhombus with rounded corners in the plan view and a central round opening engaged by a turning plate 2, which overlaps the base plate with a projecting circumferential edge 3. The turning plate 2 has a plurality of oblong holes 4, which are in a spaced arrangement and through which fastening screws 17 (FIG. 2) pass for fastening the binding to the snowboard. Fixed in place with fastening screws 6 at both ends of the base plate are mounting blocks 5 on which are fastened the usual front and heel clips 20 that overlap the sole of the snowboard boot (not shown) and thus fix the boot in place relative to the binding, the boot lying against the mounting blocks 5 in the front and heel areas. To this extent, the binding described thus far corresponds to the snowboard binding described in DE 42 19 036 A1. This binding now becomes a safety binding in that the base plate 1 can be turned relative to the snowboard and relative to the turning plate 2 when a preset torque is exceeded. At least one of the mounting blocks 5 is provided for this purpose with a stop pin 7, which projects from the associated mounting block 5 in the direction of the center of circle of the turning plate 2 and has a rounded tip. This stop pin 7 cooperates with a spring plunger 8 with a moving head 9 that is forced in the direction of stop pin 7 by a compression spring 10 arranged inside the spring plunger 8. The head 9 has a stop recess 11 which is engaged by the stop pin 7. In the plan view of FIG. 1, this stop recess has an approximately parabolic or hyperbolic curvature. However, it can also have another shape, such as a v-shaped groove, or have the shape of a circular arc or the like; it is only necessary to ensure that the shapes of the stop pin and the stop recess are matched to each other so that the head 9 is displaced against the force of the spring 10 when forces exceeding a value preset by the force of the spring 10 come into play between the stop pin 7 and the head 9.

The force of the spring 10 can be changed by an adjusting screw 12 arranged on the end of the spring plunger 8 opposite the head 9 whereby the initial tension of the spring 10 is changed.

In the normal assembly position, the spring plunger 8 is rigidly fixed in place on the turning plate 2, which is in turn rigidly fixed in place on the snowboard. With snowboard bindings, however, it is desirable to be able to adjust the binding angle, that is, the angle between the longitudinal axis of the binding and the longitudinal axis of the snowboard, which means that the angle between the longitudinal axis of the spring plunger 8 and the longitudinal axis of the snowboard must be adjusted relative to the non-twisting turning plate 2 so that the spring plunger, as shown in FIG. 1, is oriented on the longitudinal axis of the binding.

A turning disc 13 lying between the top side of the turning plate 2 and the spring plunger 8 is provided for this purpose, this disc having a central opening that is in alignment with a central opening of the turning plate 2. These two openings are tapered outwardly so that the turning disc 13 can be connected to the turning plate 2 by a countersunk anchor 15 and a countersunk screw 16. The opposing surfaces of the aforementioned openings and of the heads of the anchors 15 and screws 16 can be roughened or knurled to provide improved slip protection with respect to torques. The bottom side of the turning disc 13 and/or the opposing top side of the turning plate 2 can also be roughened or provided with any other friction surface (not shown) to provide the aforementioned slip protection.

The spring plunger 8 is provided on the side opposing the turning disc 13 with an assembly disc 13' having screw holes 14 (FIG. 1). The turning disc 13 has threaded holes associated with these screw holes 14 so that the assembly disc 13' and the turning disc 13 can be rigidly connected with one another.

On its bottom side opposite the snowboard, the turning plate 2 has a friction-hindering surface 18. In the area where it cooperates with the turning plate 2 and its projecting edge 3, the central opening of the plate 1 is provided with a slip surface 19 that is designed here as a slip ring with a u-shaped cross-section made of a highly slippery plastic or polytetrafluorethylene (PTFE). It is also to be emphasized that the bottom side of the turning plate or its friction surface 18 is rigidly pressed against the surface of the snowboard by the screws 17, while the base plate 1 is held at a slight interval over the surface of the snowboard by the slip ring 19 and its dimensions so that the base plate 1 can turn relative to the surface of the snowboard when the binding is released, the slip ring 19, in cooperation with the outer edge of the turning plate 2, its projecting edge 3, and the inwardly pointing surface of the base plate 1, serving as the "pivot bearing".

The assembly of the safety binding and the adjustment of the "binding angle" are carried out as follows.

First, the slip ring 19 is set over the central opening of the base plate 1. The countersunk anchor 15 is then inserted and the unit, which is formed by the base plate 1, slip ring 19, turning plate 2 and the countersunk anchor 15, is screwed on the snowboard, an adjustment being made of the stepping distance, that is, the distance between the two bindings over the oblong holes 4. The turning disc 13 is then fastened to the turning plate 2 with the screw 16, the turning disc with its threaded holes being aligned so that the spring plunger 8 later lies in the longitudinal direction of the binding. In other words, the binding angle is already established here. The last action is to screw the spring plunger with its assembly disc 13' to the turning disc. This completes the assembly of the binding and the base plate can then assume any turning position. Finally, the base plate is turned so that its stop pin 7 engages the stop recess 11 of the head 9, thus the turning position of the base plate is also fixed.

In order to facilitate movement into this "operating position", the head 9 has leading surfaces at the side next to the stop recess 11, which cause the head to be forced inward by the stop pin 7.

Briefly stated, the function of this binding, in the case of torsional forces acting on the base plate 1, that is, with torque action relative to an axis perpendicular to the snowboard surface, is to force the head 9 back against the force of the spring 10 until the stop pin 7 comes free of the stop recess 11. The base plate can then become free of the snowboard and can be turned without any force to speak of. In spite of this, the snowboarder's boot remains solidly connected with the binding. Following such a "release", the snowboarder simply turns his foot and hence the base plate back into the pre-set running position in which the stop pin 7 has engaged the stop recess 11.

The mounting of the head 9 relative to the spring plunger 8 can be carried out in different ways. As can be seen in FIG. 2, the head is cylindrical with a circumferential projecting edge 22, which comes to a stop against a step 23 inside the spring plunger 8. As FIG. 1 shows, the head can also be pushed from the outside over the spring plunger 8, in which case it has lateral recesses 24, which are engaged by claws (not shown) connected with the assembly disc 13' or the spring plunger 8, these claws limiting the travel path of the head 9 in both directions.

ALTERNATIVE EMBODIMENTS

Figure 3:
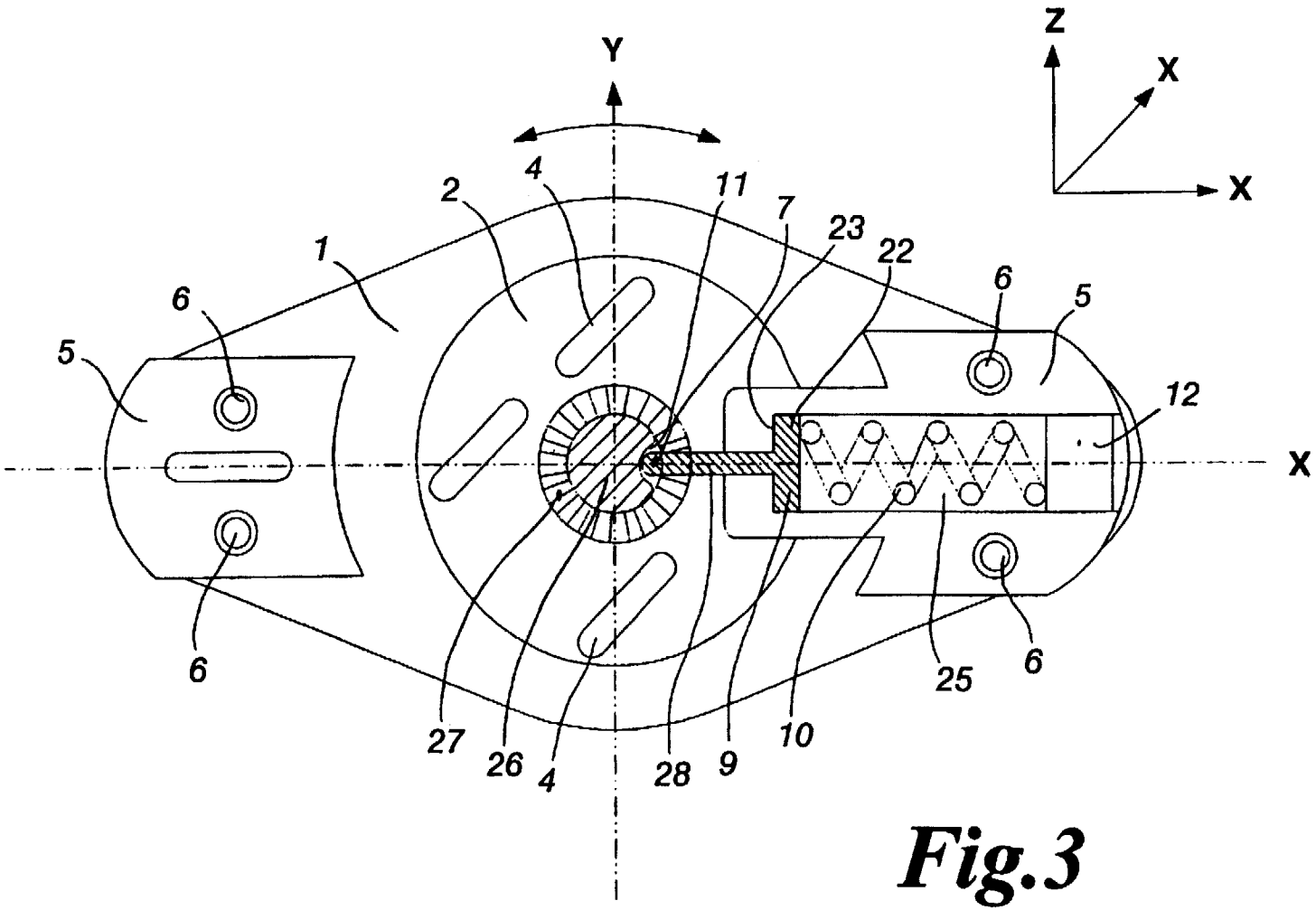
FIG. 3 is a plan view of a safety binding in accordance with a second example embodiment of the invention.
Figure 4:
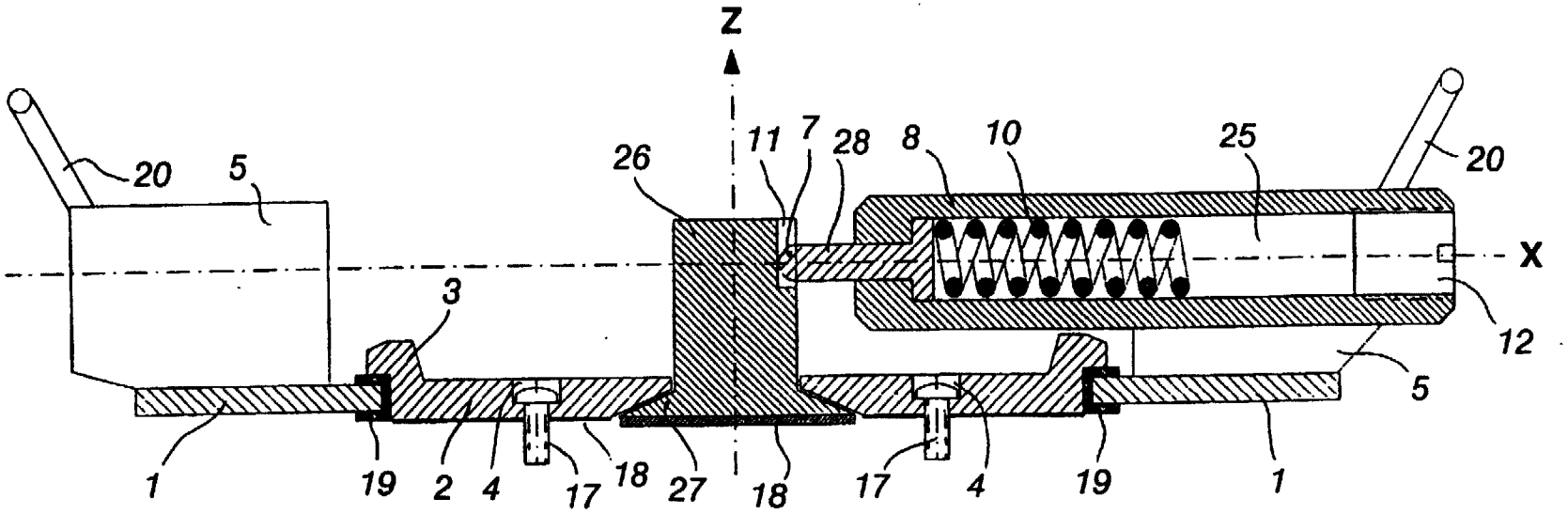
FIG. 4 is a longitudinal section of the binding according to FIG. 3.

The essential difference of the example embodiment of FIGS. 3 and 4 from that in FIGS. 1 and 2 is that spring plunger is mounted in one of the mounting blocks 5 on the base plate 1 and also contains the stop pin 7, while the opposite stop element is fixed in place with the stop recess, on the turning plate. The spring plunger is integrated here in one of the mounting blocks 5. The mounting block 5 at the right in FIG. 3 has a cavity 25 into which the movable head 9 is inserted, this head having a cylindrical extension 28, which projects out of the cavity 25 and supports the stop pin 7 on its free end. The head 9 also has a cylindrical projecting edge 22, which is forced by the spring 10 against a stop 23 inside the cavity 25. Here, too, the initial tension for the head 9 can be adjusted by an adjusting screw 12 that can be screwed into the cavity 25.

The opposite stop element consists here of an essentially cylindrical bolt 26, rising vertically through a central opening of the turning plate 2 and having the stop recess 11 engaged by the stop pin 7. The bolt 26 must be rotatable for adjustment of the binding angle relative to the turning plate 2; however, it must be held in the assembled position so that it cannot turn on the turning plate 2. As in the case with the countersunk anchor 15 in FIG. 2, this requires that the bolt 26 be threaded at the end directed toward the snowboard surface or, in a variant of the invention, that the bolt have a radially projecting ring integrally formed with the bolt and have a shape similar to that of the countersunk anchor 15. On its side pointing upward, that is, toward the turning plate 2, this ring 27 has knurling or teeth, the opposing surface in the turning plate having corresponding teeth. When the turning plate 2 is solidly screwed to the snowboard, the latter presses against the ring 27 and thus fixes the bolt 26 so that it cannot turn relative to the turning plate.

Figure 5:
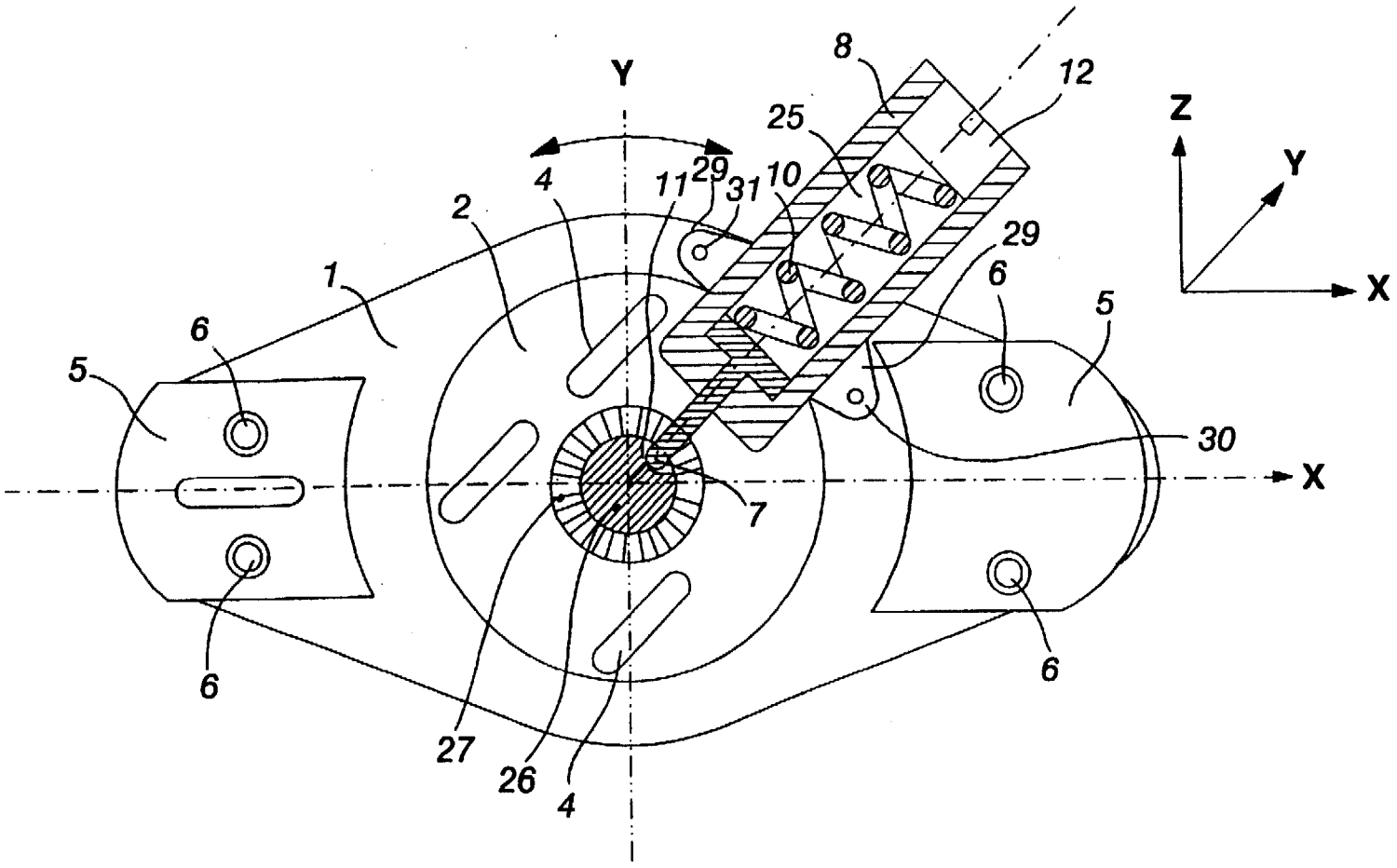
FIG. 5 is a plan view of a safety binding in accordance with a third example embodiment of the invention.

The difference of the embodiment of FIG. 5 from the embodiments of FIGS. 3 and 4 is only that the spring plunger is not integrated with one of the mounting blocks 5 but rather is screwed as a separate component to the base plate 1. For this purpose, the spring plunger 8 has two side flanges 29 with screw holes 30. The function of the binding in FIG. 5 is otherwise completely the same as that of FIGS. 3 and 4.

What is claimed is:

1. A safety binding for attachment to a snowboard, said safety binding comprising:

a base plate having a circular central opening therethrough and having an upper surface;

a circular turning plate positioned within the central opening of said base plate for attachment to the snowboard, said turning plate having a radially projecting edge that overlaps said upper surface of said base plate to prevent translation of said base plate relative to said turning plate and the snowboard while permitting rotation of said base plate relative to said turning plate and the snowboard; and means for releasably locking said base plate against rotation relative to said turning plate and the snowboard, said means for releasably locking comprising:

a spring fixed to said base plate;

a cylindrical bolt positioned within the central opening of said base plate so that said turning plate is positioned radially between said base plate and said bolt, said bolt being fixed relative to said turning plate and the snowboard in operation;

a stop recess formed in the exterior surface of said bolt and fixed against rotation relative to said turning plate and the snowboard; and a stop pin fixed to said base plate, positioned adjacent an end of said spring, and releasably engagable in said stop recess;

whereby said means for releasably locking releases said base plate for rotation relative to said turning plate and the snowboard when a predetermined torque about an axis perpendicular to the snowboard is exceeded.

2. A safety binding according to claim 1, wherein said bolt depends perpendicularly from said turning plate and further comprising an annular ring defining a friction surface for fixing said bolt against rotation relative to said turning plate and the snowboard.

3. A safety binding according to claim 2, wherein the angular position of said stop recess formed in said bolt is adjustable relative to said base plate so that said means for releasably locking may be offset from the longitudinal axis of said base plate.

4. A safety binding according to claim 1, wherein said stop pin compresses said spring when said base plate is rotated relative to said turning plate and the snowboard.

5. A safety binding according to claim 1, wherein at least a portion of the underside of said turning plate defines a friction surface for fixing said turning plate against rotation relative to the snowboard.

* * * * *